United States Patent [19]

Sakai et al.

[11] 4,266,020

[45] May 5, 1981

[54] COLOR PHOTOGRAPHIC LIGHT-SENSITIVE MATERIAL

[75] Inventors: Nobuo Sakai; Kotaro Nakamura; Masakazu Morigaki; Nobuo Furutachi, all of Minami-ashigara, Japan

[73] Assignee: Fuji Photo Film Co., Ltd., Minami-ashigara, Japan

[21] Appl. No.: 81,986

[22] Filed: Oct. 4, 1979

[30] Foreign Application Priority Data

Oct. 5, 1978 [JP] Japan ..... 53-12307

[51] Int. Cl.[1] .....G03C 1/40; G03C 7/00

[52] U.S. Cl. .....430/551; 430 216; 430/504; 430/512; 430/552; 430/554

[58] Field of Search ..... 430/551, 557, 558, 611, 430/614, 931, 933, 216, 552, 554, 512, 504

[56] References Cited

U.S. PATENT DOCUMENTS

| | | | |
|---|---|---|---|
| 3,460,942 | 8/1969 | Rogers | 430/931 |
| 3,700,455 | 10/1972 | Ishikawa et al. | 430/512 |
| 4,113,495 | 9/1978 | Shishido et al. | 430/372 |
| 4,178,184 | 12/1979 | Taguchi et al. | 430/551 |

*Primary Examiner*—J. Travis Brown

*Attorney, Agent, or Firm*—Sughrue, Rothwell, Mion, Zinn and Macpeak

[57] ABSTRACT

A color photographic color coupler-containing light-sensitive material containing, in a photographic layer, at least one compound represented by the following general formula (I):

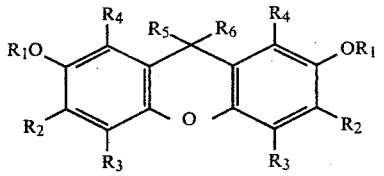

(I)

wherein $R_1$ represents a hydrogen atom, an alkyl group, a heterocyclic group, a dialkylsilyl group, a trialkylsilyl group, an alkanesulfonyl group, an arylsulfonyl group, an aralknesulfonyl group or an -X-Y group in which X represents a carbonyl group, and Y represents an alkyl group, an aryl group, an aralkyl group, an alkoxy group, an aryloxy group, an aralkoxy group, an alkylamino group, a dialkylamino group, an arylamino or diarylamino group, an alkoxycarbonyl group, an aryloxycarbonyl group, an aralkoxycarbonyl group or an acyl group; $R_2$, $R_3$ and $R_4$, which may be the same or different, each represents a hydrogen atom, an alkyl group, an alkoxy group, an aryl group, an aryloxy group, an aralkyl group, an aralkoxy group, an alkenyl group, an alkenoxy group, an acylamino group, a halogen atom, an alkylthio group, an arylthio group, a diacylamino group, an acyl group, a sulfonamido group, an alkylamino group, an alkoxycarbonyl group or an acyloxy group; and $R_5$ and $R_6$, which may be the same or different, each represents a hydrogen atom, an alkyl group, an aryl group or an aralkyl group, or $R_5$ and $R_6$ are bonded each other to form a 5-membered, 6-membered or 7-membered ring.

20 Claims, No Drawings

COLOR PHOTOGRAPHIC LIGHT-SENSITIVE MATERIAL

BACKGROUND OF THE INVENTION

1. Field of the Invention

The present invention relates to a color photographic light-sensitive material and, more particularly, it relates to preventing the fading of dye images finally obtained upon development-processing a color photographic light-sensitive material and preventing discloration of uncolored areas (hereinafter referred to as white background).

2. Description of the Prior Art

Color images obtained by photographically processing a silver halide color photographic light-sensitive material comprise, in general, an azomethine dye or indoaniline dye image formed by the reaction between an oxidation product of an aromatic primary amine developing agent and a coupler.

The thus-obtained color photographic images are stored for a long period of time as records or displayed. However, these photographic images are not necessarily stable to light, humidity or heat and, when exposed to light for a long period of time or stored under high temperature and humidity conditions, the dye images tend to fade or discolor and, in addition, the white background is colored, usually resulting in a deterioration of image quality.

This fading and discoloration of images are quite serious defects in a recording material. The following compounds have heretofore been used to remove these defects. For example, hydroquinone derivatives including 2,5-di-tert-butylhydroquinone, phenol derivatives such as 2,6-di-tert-butyl-p-cresol, 4,4'-methylenebis-(2,6-di-tert-butylphenol), 2,2'-methylenebis(4-ethyl-6-tert-butylphenol), 4,4'-isopropylidenediphenol, etc., and tocopherols are representative of such compounds.

These compounds are effective to some extent as an agent which prevents fading or discoloration of dye images. However, the effect is not completely satisfactory or, although some compounds may prevent fading, they deteriorate hue, generate fog, lower dispersion property or form crystals. Thus, no satisfactory color image stabilizers which exhibit completely excellent effects for photographic use are known.

SUMMARY OF THE INVENTION

An object of the present invention is to provide a color photographic light-sensitive material capable of providing stable color images which comprises a color photographic light-sensitive material containing in a photographic light-sensitive layer a color image stabilizer having an effect sufficient to prevent fading or discoloration of color images without the deterioration of hue and the generation of fog.

As a result of various investigations, it has now been discovered that the objects of the present invention are attained by the incorporation in a photographic layer of a color photographic light-sensitive material of at least one compound represented by the following general formula (I):

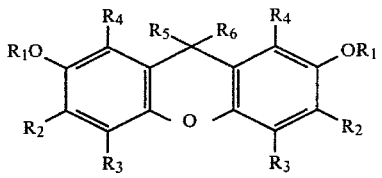

(I)

wherein $R_1$ represents a hydrogen atom, a straight chain, branched chain or cyclic alkyl group having 1 to 20 carbon atoms, a heterocyclic group, a dialkylsilyl group, a trialkylsilyl group, a straight chain, branched chain or cyclic alkanesulfonyl group having 1 to 20 carbon atoms, a substituted or unsubstituted arylsulfonyl group, an aralkanesulfonyl group or an -X-Y group in which X represents >C=O ( a carbonyl group) X, and Y represents a straight chain, branched chain or cyclic alkyl group having 1 to 20 carbon atoms, a substituted or unsubstituted aryl group, an aralkyl group, an alkoxy group containing a straight chain, branched chain or cyclic alkyl group having 1 to 20 carbon atoms, a substituted or unsubstituted aryloxy group, an aralkyloxy group, an alkylamino group having 1 to 20 carbon atoms, a dialkylamino group, a substituted or unsubstituted arylamino group, a diarylamino group, an alkoxycarbonyl group containing a straight chain, branched chain or cyclic alkyl group having 1 to 20 carbon atoms, a substituted or unsubstituted aryloxycarbonyl group, an aralkoxycarbonyl group or an acyl group; $R_2$, $R_3$ and $R_4$, which may be the same or different, each represents a hydrogen atom, a straight chain, branched chain or cyclic alkyl group having 1 to 20 carbon atoms, a straight chain, branched chain or cyclic alkoxy group having 1 to 20 carbon atoms, a substituted or unsubstituted aryl group, a substituted or unsubstituted aryloxy group, an aralkyl group, an aralkoxy group, an alkenyl group, an alkenoxy group, an acylamino group, a halogen atom, an alkylthio group containing a straight chain, branched chain or cyclic alkyl group having 1 to 20 carbon atoms, a substituted or unsubstituted arylthio group, a diacylamino group, a substituted or unsubstituted acyl group having 1 to 20 carbon atoms, a sulfonamido group, an alkylamino group containing a straight chain or branched chain alkyl group having 1 to 20 carbon atoms, an alkoxycarbonyl group containing a straight chain or branched chain alkyl group having 1 to 20 carbon atoms, or an acyloxy group having 1 to 20 carbon atoms; and $R_5$ and $R_6$, which may be the same or different, each represents a hydrogen atom, a straight chain, branched chain or cyclic alkyl group having 1 to 20 carbon atoms, a substituted or unsubstituted aryl group or an aralkyl group or $R_5$ and $R_6$ combine to form a 5-membered, 6-membered or 7-membered ring.

DETAILED DESCRIPTION OF THE INVENTION $R_1$ in the general formula(I) is described in more detail below. $R_1$ represents a hydrogen atom, a straight chain, branched chain or cyclic alkyl group having 1 to 20 carbon atoms (for example, a methyl group, an ethyl group, an isopropyl group, a tert-butyl group, an n-octyl group, a tert-octyl group, a dodecyl group, a hexadecyl group, a cyclohexyl group, etc.), a heterocyclic group (for example, a 5- or 6-membered saturated or aromatic heterocyclic group, preferably a saturated heterocyclic group, containing at least one hetero atom such as an oxygen atom, a nitrogen atom and a sulfur atom and when two or more hetero atoms are present the hetero atoms may be the same or different, e.g., a tetrahydropyranyl group, etc.), a dialkylsilyl group having total carbon atoms of 2 to 22 (for example, a dimethylsilyl group, etc.), a trialkylsilyl group having total carbon atoms of 3 to 22 (for example, a trimethylsilyl group, etc.), a straight chain, branched chain or cyclic alkanesulfonyl group having 1 to 20 carbon atoms (for example, a methanesulfonyl group, a propanesulfonyl group, a tert-octanesulfonyl group, an octadecanesulfonyl group, a cyclohexanesulfonyl group, etc.), a substituted or unsubstituted arylsulfonyl ($C_6$–$C_{22}$) group (for example, a benzenesulfonyl group, an α-naphthalenesulfonyl group, a p-chlorobenzenesulfonyl group, a p-methoxybenzenesulfonyl group, an o-methylbenzenesulfonyl group, etc.), or an mono or bicyclic aralkanesulfonyl ($C_7$–$C_{22}$) group (for example, a benzylsulfonyl group, a β-phenethylsulfonyl group, etc.). Suitable substituents for the arylsulfonyl group $R_1$ are an alkyl group (for example, a methyl group, an ethyl group, a butyl group, an octyl group, a dodecyl group, an octadecyl group, etc.), a halogen atom (for example, a chlorine atom, a bromine atom, etc.), a cyano group, an alkoxy group (for example, a methoxy group, an ethoxy group, a cyclohexyloxy group, a 2-ethylhexyloxy group, an octadecyloxy group, etc.), an alkoxycarbonyl group (for example, a methoxycarbonyl group, an ethoxycarbonyl group, a tetradecyloxycarbonyl group, etc.), an acylamino group (for example, an acetylamino group, a tetradecaneamido group, etc.), a sulfonamido group (for example, a benzenesulfonamido group, a toluenesulfonamido group, a dodecylsulfonamido group, a methanesulfonamido group, etc.), an alkylthio group (for example, an ethylthio group, an octylthio group, a benzylthio group, a dodecylthio group, a 3-(phenoxy)-propylthio group, a octadecylthio group, etc.), and an alkylsulfonyl group (for example, an ethylsulfonyl group, a dodecylsulfonyl group, an octadecylsulfonyl group, etc.).

Y in the -X-Y group is described in more detail below. Y represents a straight chain, branched chain or cyclic alkyl group having 1 to 20 carbon atoms (for example, a methyl group, a tert-butyl group, a cyclohexyl group, a tertoctyl group, a dodecyl group, an octadecyl group, a β-acetylaminopropyl group, etc.), a substituted or unsubstituted mono- or bi-cyclic aryl ($C_6$–$C_{22}$) group (for example, a phenyl group, a p-methylphenyl group, a p-methoxyphenyl group, an m-nitrophenyl group, an o-chlorophenyl group, an α-naphthyl group, etc.), a mono- or bi-cyclic aralkyl ($C_7$–$C_{22}$) group (for example, a benzyl group, a phenethyl group, etc.), a straight chain, branched chain or cyclic alkoxy group having 1 to 20 carbon atoms (for example, a methoxy group, a tert-butoxy group, a cyclohexyloxy group, a β-benzenesulfonylethoxy group, a dodecyloxy group, an octadecyloxy group, etc.), a substituted or unsubstituted mono- or bi-cyclic aryloxy($C_6$–$C_{22}$) group (for example, a phenoxy group, a p-methylphenoxy group, a p-methoxyphenoxy group, a p-isopropylphenoxy group, an m-nitrophenoxy group, a 2,4,6-trichlorophenoxy group, an o-chlorophenoxy group, an α-naphthyloxy group, a β-naphthyloxy group, etc.), a mono- or bi-cyclic aralkoxy ($C_7$–$C_{22}$) group (for example, a benzyloxy group, a phenethyloxy group, etc.), an alkylamino group or dialkylamino group wherein each alkyl moiety has 1 to 20 carbon atoms (for example, a methylamino group, an ethylamino group, a diethylamino group, an octadecylamino group, a dioctylamino group, etc.), a substituted or unsubstituted mono- or bi-cyclic arylamino ($C_6$–$C_{22}$) group or diarylamino ($C_{12}$–$C_{44}$) group (for example, a phenylamino group, a p-methylphenylamino group, p-nitrophenylamino group, an N,N-diphenylamino group, an α-naphthylamino group, etc.), an alkoxycarbonyl group containing a straight chain, branched chain or cyclic alkyl group having 1 to 20 carbon atoms (for example, a methoxycarbonyl group, a tert-butoxycarbonyl group, a cyclohexyloxycarbonyl group, an octyloxycarbonyl group, etc.), a substituted or unsubstituted mono- or bicyclic aryloxycarbonyl ($C_7$–$C_{22}$) group (for example, a phenoxycarbonyl group, a p-methylphenoxycarbonyl group, a p-methoxyphenoxycarbonyl group, an m-nitrophenoxycarbonyl group, an o-chlorophenoxycarbonyl group, etc.), a mono- or bicyclic aralkoxycarbonyl ($C_8$–$C_{23}$) group (for example, a benzyloxycarbonyl group, a phenethyloxycarbonyl group, etc.), or an acyl ($C_2$–$C_{22}$) group (for example, an acetyl group, a benzoyl group, an octanoyl group, etc.).

Suitble substituents for the aryl group, the aryloxy group, the arylamino group and the aryloxycarbonyl group Y are an alkyl group (for example, a methyl group, an ethyl group, a butyl group, an octyl group, a dodecyl group, an octadecyl group, etc.), a halogen atom (for example, a chlorine atom, a bromine atom, etc.), a cyano group, an alkoxy group (for example, a methoxy group, an ethoxy group, a cyclohexyloxy group, a 2-ethylhexyloxy group, an octadecyloxy group, etc.), an alkoxycarbonyl group (for example, a methoxycarbonyl group, an ethoxycarbonyl group, a tetradecyloxycarbonyl group, etc.), an acylamino group (for example, an acetylamino group, a tetradecaneamido group, etc.), a sulfonamido group (for example, a benzenesulfonamido group, a toluenesulfonamido group, a dodecylsulfonamido group, a methanesulfonamido group, etc.), an alkylthio group (for example, an ethylthio group, an octylthio group, a benzylthio group, a dodecylthio group, a 3-(phenoxy)-propylthio group, a octadecylthio group, etc.), and an alkylsulfonyl group (for example, an ethylsulfonyl group, a dodecylsulfonyl group, an octadecylsulfonyl group, etc.).

Suitable substituents for the alkoxy group of Y are an alkyl group (for example, a methyl group, an ethyl group, a butyll group, an octyl group, a dodecyl group, an octadecyl group, etc.), a halogen atom (for example, a chlorine atom, a bromine atom, etc.), a cyano group, an alkoxy group (for example, a methoxy group, an ethoxy group, a cyclohexyloxy group, a 2-ethylhexyloxy group, an octadecyloxy group, etc.), an alkoxycarbonyl group (for example, a methoxycarbonyl group, an ethoxycarbonyl group, a tetradecyloxycarbonyl group, etc.), an acylamino group (for example, an acetylamino group, a tetradecaneamido group, etc.), a sulfonamido group (for example, a benzenesulfonamido group, a toluenesulfonamido group, a dodecylsulfonamido group, a methanesulfonamido group, etc.), an alkylthio group (for example, an ethylthio group, an octylthio group, a benzylthio group, a dodecylthio group, a 3-(phenoxy)-propylthio group, a octadecylthio group, etc.), an alkylsulfonyl group (for example, an ethylsulfonyl group, a dodecylsulfonyl group, an octadecylsulfonyl group, etc.), and an acyl group (for example, an acetyl group).

$R_2$, $R_3$ and $R_4$ in the general formula(I) each represents, in more detail, a hydrogen atom, a straight chain, branched chain or cyclic alkyl group having 1 to 20 carbon atoms (for example, a methyl group, a tert-butyl group, a cyclopentyl group, a cyclohexyl group, an octyl group, a tert-octyl group, a tert-amyl group, a dodecyl group, an octadecyl group, etc.), a straight chain, branched chain or cyclic alkoxy group having 1 to 20 carbon atoms (for example, a methoxy group, a tert-butoxy group, a cyclohexyloxy group, a dodecyloxy group, an octadecyloxy group, etc.) a substituted or unsubstituted mono- or bi-cyclic aryl ($C_6$–$C_{22}$) group (for example, a phenyl group, a p-methylphenyl group, a p-methoxyphenyl group, a p-octanamidophenyl group, an o-chlorophenyl group, an o-methylphenyl group, an m-nitrophenyl group, an α-naphtyl group, etc.), a substituted or unsubstituted mono- or bi-cyclic aryloxy ($C_6$–$C_{22}$) group (for example, a phenoxy group, an α-naphthoxy group, a p-methylphenoxy group, a p-methoxyphenoxy group, a p-capramidophenoxy group, an o-chlorophenoxy group, an m-nitrophenoxy group, etc.), a mono- or bi-cyclic aralkyl ($C_7$–$C_{22}$) group (for example, a benzyl group, a phenethyl group, etc.), a mono- or bi-cyclic aralkoxy ($C_7$–$C_{22}$) group (for example, a benzyloxy group, a phenethyloxy group, etc.), a straight chain, branched chain or cyclic alkenyl ($C_2$–$C_{22}$) group (for example, an allyl group, etc.), an alkenoxy ($C_2$–$C_{22}$) group (for example, an allyloxy group, etc.), an aliphatic or aromatic acylamino ($C_2$–$C_{22}$) group (for example, an acetylamino group, a benzoylamino group, a capramido group, etc.), a halogen atom (for example, a chlorine atom, etc.), an alkylthio group containing a straight chain, branched chain or cyclic alkyl group having 1 to 20 carbon atoms (for example, a methylthio group, a tert-butylthio group, a hexylthio group, a cyclohexylthio group, an octadecylthio group, etc.), a substituted or unsubstituted mono- or bicyclic arylthio ($C_6$–$C_{22}$) group (for example, a phenylthio group, a p-methylphenylthio group, an o-carboxyphenylthio group, an o-methylphenylthio group, an o-methoxycarbonylphenylthio group, an m-nitrophenylthio group, etc.), an aliphatic or aromatic diacylamino ($C_2$–$C_{44}$) group (for example, a succinimido group, a 3-hydantoinyl group, etc.), a substituted or unsubstituted aromatic or aliphatic acyl group having 1 to 20 carbon atoms (for example, an acetyl group, a caproyl group, a p-methoxybenzoyl group, etc.), an aliphatic or aromatic sulfonamido ($C_1$–$C_{22}$) group (for example, methanesulfonamido group, a benzenesulfonamido group, etc.), an alkylamino group containing a straight chain or branched chain alkyl group having 1 to 20 carbon atoms (for example, an ethylamino group, a tert-butylamino group, a dioctylamino group, an octadecylamino group, etc.), an alkoxycarbonyl group containing a straight chain or branched chain alkyl group having 1 to 20 carbon atoms (for example, a methoxycarbonyl group, a tert-butoxycarbonyl group, an octadecyloxycarbonyl group, etc.), or an aromatic or aliphatic acyloxy group having 1 to 20 carbon atoms (for example, an acetoxy group, a caproyloxy group, a lauroyloxy group, a benzoyloxy group, etc.).

Suitable substituents for the aryl group, the aryloxy group, the arylthio group and the aromatic or aliphatic acyl group for $R_2$, $R_3$ and $R_4$ are an alkyl group (for example, a methyl group, an ethyl group, a butyl group, an octyl group, a dodecyl group, an octadecyl group, etc.), a halogen atom (for example, a chlorine atom, a bromine atom, etc.), a cyano group, an alkoxy group (for example, a methoxy group, an ethoxy group, a cyclohexyloxy group, a 2-ethylhexyloxy group, an octadecyloxy group, etc.), an alkoxycarbonyl group (for example, a methoxycarbonyl group, an ethoxycarbonyl group, a tetradecyloxycarbonyl group, etc.), an acylamino group (for example, an acetylamino group, a tetradecaneamido group, etc.), a sulfonamido group (for example, a benzenesulfonamido group, a toluenesulfonamido group, a dodecylsulfonamido group, a methanesulfonamido group, etc.), an alkylthio group (for example, an ethylthio group, an octylthio group, a benzylthio group, a dodecylthio group, a 3-(phenoxy)-propylthio group, a octadecylthio group, etc.), and an alkylsulfonyl group (for example, an ethylsulfonyl group, a dodecylsulfonyl group, an octadecylsulfonyl group, etc.).

$R_5$ and $R_6$ in the general formula (I) each represents, in more detail, a hydrogen atom, a straight chain, branched chain or cyclic alkyl group having 1 to 20 carbon atoms (for example, a methyl group, an ethyl group, a propyl group, a cyclohexyl group, a tert-butyl group, a dodecyl group, an octadecyl group, etc.), a substituted or unsubstituted mono- or bi-cyclic aryl ($C_6$–$C_{22}$) group (for example, a phenyl group, an α-naphthyl group, a p-methylphenyl group, an o-methoxyphenyl group, a 2,4-dichlorophenyl group, a 2,4,6-trichlorophenyl group, 2-methyl-4,6-dichlorophenyl group, etc.) or a mono- or bi-cyclic aralkyl ($C_7$–$C_{22}$) group (for example, a benzyl group, a phenethyl group, etc.), or $R_5$ and $R_6$ are bonded to each other to form a 5-, 6- or 7-membered saturated or unsaturated ring (for example, the ring formed by the combination of $R_5$ and $R_6$ is a 5-, 6- or 7-membered saturated or unsaturated ring, e.g., a cyclopentane ring, a cyclohexane ring, a cycloheptane ring, a cyclohexadiene ring, etc.).

Suitable substituents for the aryl group of $R_5$ and $R_6$ are an alkyl group (for example, a methyl group, an ethyl group, a butyl group, an octyl group, a dodecyl group, an octadecyl group, etc.), a halogen atom (for example, a chlorine atom, a bromine atom, etc.), a cyano group, an alkoxy group (for example, a methoxy group, an ethoxy group, a cyclohexyloxy group, a 2-ethylhexyloxy group, an octadecyloxy group, etc.), an alkoxycarbonyl group (for example, a methoxycarbonyl group, an ethoxycarbonyl group, a tetradecyloxycarbonyl group, etc.), an acylamino group (for example, an acetylamino group, a tetradecaneamido group, etc.), a sulfonamido group (for example, a benzenesulfonamido group, a toluenesulfonamido group, a dodecylsulfonamido group, a methanesulfonamido group, etc.), an alkylthio group (for example, an ethylthio group, an octylthio group, a benzylthio group, a dodecylthio group, a 3-(phenoxy)-propylthio group, an octadecylthio group, etc.), and an alkylsulfonyl group (for example, an ethylsulfonyl group, a dodecylsulfonyl group, an octadecylsulfonyl group, etc.).

Of the compounds represented by the general formula (I), those compounds in which $R_1$ represents a hydrogen atom, an alkyl group or an acyl group, $R_2$, $R_3$ and $R_4$ each represents an alkyl group and $R_5$ and $R_6$ each represents a hydrogen atom or an alkyl group are particularly preferred from the standpoint of obtaining the largest effects according to the present invention.

Furthermore, particularly preferred effects are obtained when the compound represented by the general formula (I) is employed together with a magenta coupler, particularly a 5-pyrazolone type compound or a cyan coupler, particularly a phenol or naphthol derivative.

Moreover, more superior effects are achieved when the compound represented by the general formula (I) is used in a combination with a hydroquinone derivative that is a known fade-preventing agent.

Typical examples of these compounds are illustrated below, but the compounds which can be used in the present invention are not to be construed as being limited to these examples in any way.

Compound (1)

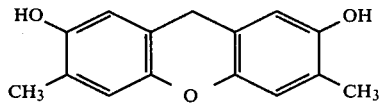

Compound (2)

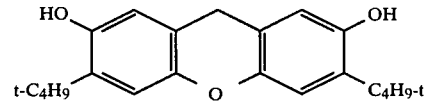

Compound (3)

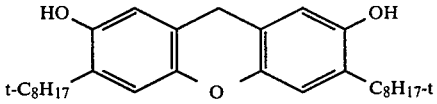

Compound (4)

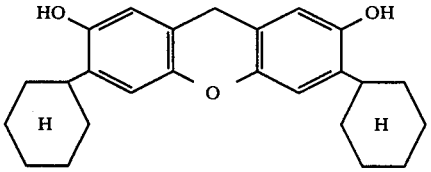

Compound (5)

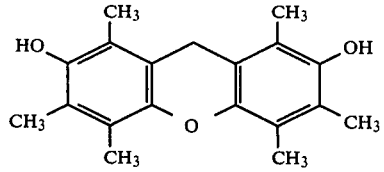

Compound (6)

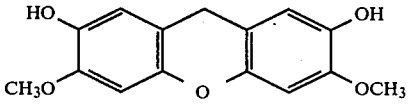

Compound (7)

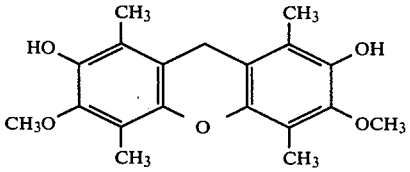

Compound (8)

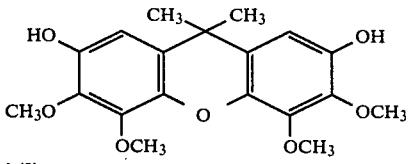

Compound (9)

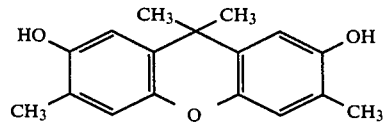

-continued

Compound (10)

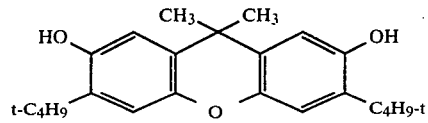

Compound (11)

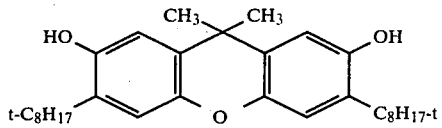

Compound (12)

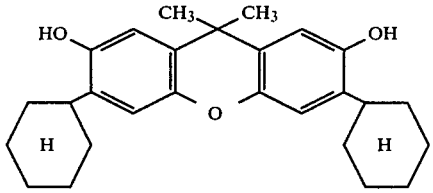

Compound (13)

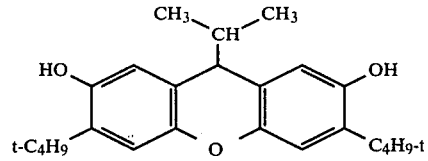

Compound (14)

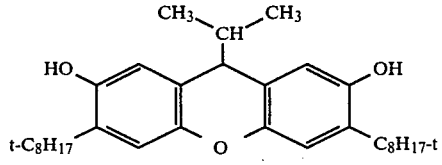

Compound (15)

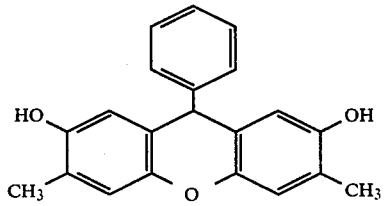

Compound (16)

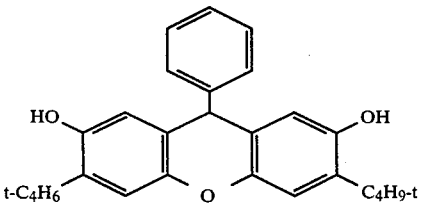

Compound (17)

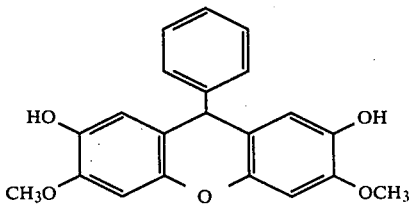

Compound (18)

-continued

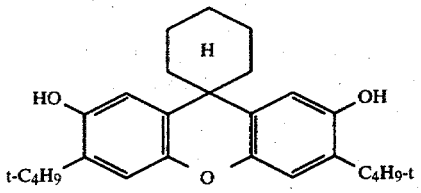

Compound (19)

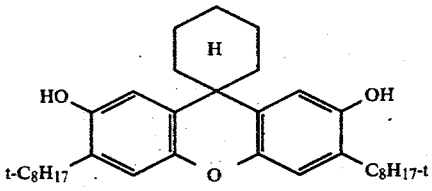

Compound (20)

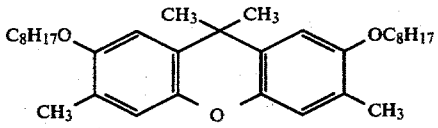

Compound (21)

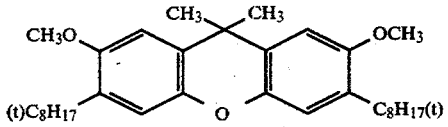

Compound (22)

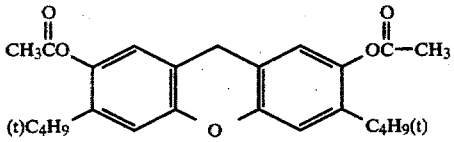

Compound (23)

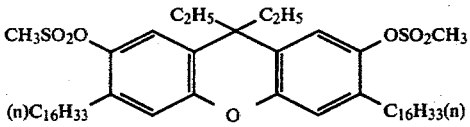

Compound (24)

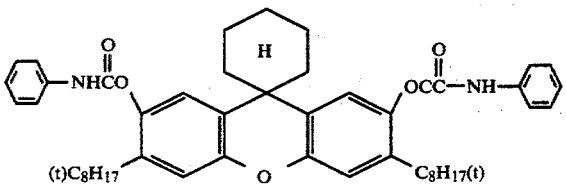

Compound (25)

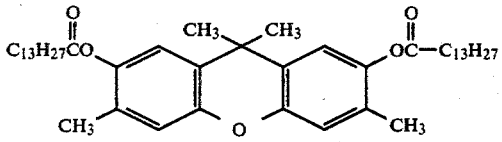

Compound (26)

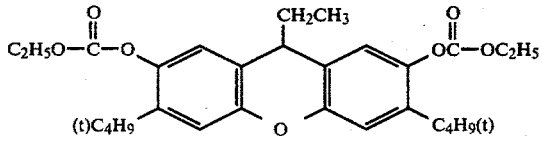

Compound (27)

-continued

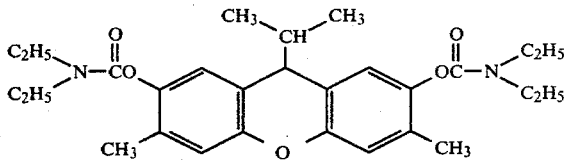

Compound (28)

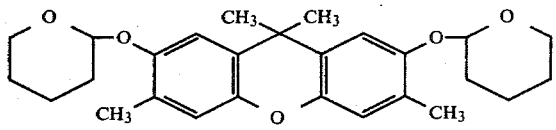

Compound (29)

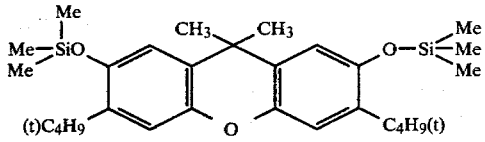

Compound (30)

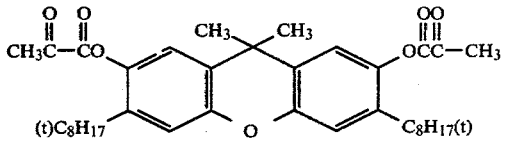

Compound (31)

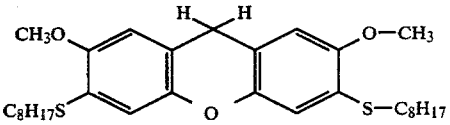

Compound (32)

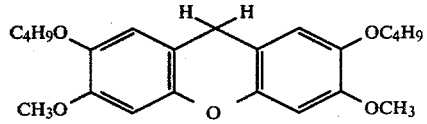

The compounds according to the present invention can be synthesized by reference to the methods described in *Journal of the American Chemical Society*, Vol. 72, pages 3651 to 3655 or similar methods. A nuclear-substituted hydroquinone, as a starting material, is dissolved in a weak acidic carboxylic acid solvent such as acetic acid in an amount of about $10^{-2}$ mol/l to 5 mol/l and, a strong acidic compound such as hydrochloric acid is added to the solution in an amount of about 0.1 to 5 times w/w (weight ratio) based on the starting material. A condensing agent such as formalin, acetone or aldehydes is added to the solution in an amount of about 0.5 to 5 moles based on the starting material and the resulting solution is stirred at about 10° to 100° C. to obtain a diarylmethane compound. The resulting diarylmethane compound is dissolved in a solvent such as a hydrocarbon solvent (for example, benzene, toluene), an alcohol solvent (for example, ethanol, propanol), or an organic acid (for example, acetic acid) and, the solution is heated with refluxing in the presence or non-presence of a strong acid (for example, methane sulfonic acid, toluene sulfonic acid, sulfuric acid) in an amount of about 0.1 to 1.0 mole based on the starting material to obtain an objective compound of a xanthene compound. Specific synthesis examples are illustrated below for reference.

SYNTHESIS EXAMPLE 1

Synthesis of Compound (5)

30 g of trimethylhydroquinone was dissolved by heating in 400 ml of acetic acid and to the solution 800 ml of water was added. Further, 60 ml of concentrated hydrochloric acid was added and to the mixture 12 g of a 40% formalin was added with stirring while refluxing by heating. After cooling, the crystals precipitated were collected by filtration, washed with cold water and dried under reduced pressure. To a solution of the crude crystals in acetone, petroleum ether (b.p.: 60° to 68° C.) was added. The resulting crystals were collected by filtration and dried under reduced pressure to obtain 23.5 g of white crystals of 2,5,2',5'-tetrahydroxy-3,4,6,3',4',6'-hexamethyldiphenylmethane. Melting Point: 222° to 227° C.

Elemental Analysis: Calculated for $C_{19}H_{24}O_4$: C: 72.12%, H: 7.65%; Found: C: 72.15%, H: 7.92%

20 g of 2,5,2',5'-tetrahydroxy-3,4,6,3',4',6'-hexamethyldiphenylmethane was dissolved by heating in 500 ml of ethanol. The solution was filtered to remove the insoluble materials and the filtrate was cooled. The crystals precipitated were collected by filtration to obtain 14 g of white crystals of 1,3,4,5,6,8-hexamethyl-2,7-dihydroxyxanthene. Melting Point: 260° to 268° C.

Elemental Analysis: Calculated for $C_{19}H_{22}O_3$: C: 76.48%, H: 7.43%; Found: C: 76.73%, H:7.69%

SYNTHESIS EXAMPLE 2

Synthesis of Compound (10)

67.2 g of tert-butylhydroquinone was dissolved in 200 ml of acetic acid. To the solution, 23.2 g of acetone and 136 ml of concentrated hydrochloric acid were added and the mixture was sufficiently stirred. The mixture was left at 20° to 25° C. After 4 or 5 days the crystals began to deposit. After the mixture was left another 10 days, the crystals deposited were collected by filtration, washed sufficiently with water and dried. 24.5 g of the crude crystals thus obtained were dissolved in 250 ml of a solvent mixture of benzene and ethyl acetate (3:1). After filtration, ½ part of the solvent was removed under reduced pressure and the residue was cooled. The crystals were collected by filtration to obtain 16.4 g of white crystals of 2,2'-isopropylidenebis(2,5-dihydroxy-4-tert-butylbenzene). Melting Point: 232° to 235° C.

Elemental Analysis: Calculated for $C_{23}H_{32}O_4$: C: 74.16%, H: 8.66%; Found: C: 74.17%, H: 8.73%

11 g of 2,2'-isopropylidenebis(2,5-dihydroxy-4-tert-butylbenzene) was dissolved in 400 ml of acetic acid and the solution was heated on a water bath for 5 hours. 400 ml of ethyl acetate was added to the mixture and the mixture was washed sufficiently with water. The ethyl acetate layer was separated, dried with anhydrous sodium sulfate and concentrated under reduced pressure. The residue was recrystallized from benzene to obtain 7.8 g of white crystals of 3,6-di-tert-butyl-2,7-dihydroxyxanthene. Melting Point: 232° to 235° C.

Elemental Analysis: Calculated for $C_{23}H_{30}O_3$: C: 77.93%, H: 8.53%; Found: C: 77.54%, H: 8.72%

SYNTHESIS EXAMPLE 3

Synthesis of Compound (11)

88.8 g of tert-octylhydroquinone was dissolved in 200 ml of acetic acid. To the solution, 23.2 g of acetone and 68 ml of concentrated hydrochloric acid were added and the mixture was sufficiently stirred. The mixture was left at 20° to 25° C. After 7 days the crystals deposited were collected by filtration, washed sufficiently with water, dried and recrystallized from benzene to obtain 52 g of white crystals of 2,2'-isopropylidenebis(2,5-dihydroxy-4-tert-octylbenzene). Melting Point: 247° to 249° C.

Elemental Analysis: Calculated for $C_{31}H_{48}O_4$: C: 76.82%, H: 9.98%; Found: C: 76.69%, H: 9.91%

24 g of 2,2'-isopropylidenebis (2,5-dihydroxy-4-tert-octylbenzene) was dissolved in 700 ml of benzene and to the solution, 2.4 g of p-toluene sulfonic acid was added. The mixture was refluxed by heating on a water bath for 3 hours. After the completion of the reaction, 300 ml of ethyl acetate was added and the mixture was washed sufficiently with water. The organic solvent layer was separated, dried with anhydrous sodium sulfate and concentrated under reduced pressure. The residue was recrystallized from n-hexane to obtain 17.2 g of white crystals of 3,6-di-tert-octyl-2,7-dihydroxyxanthene. Melting Point: 131° to 133° C.

Elemental Analysis: Calculated for $C_{31}H_{46}O_3$: C: 79.78%, H: 9.93%; Found: C: 79.48%, H: 10.32%

Examples of the couplers which can be used in the present invention include the following couplers. Examples of yellow couplers which can be used generally include openchain ketomethylene compounds such as those described in, e.g., U.S. Pat. Nos. 3,341,331, 2,875,057, 3,551,155, German Patent Application (OLS) 1,547,868, U.S. Pat. Nos. 3,265,506, 3,582,322, 3,725,072, German Patent Application (OLS) 2,162,899, U.S. Pat. Nos. 3,369,895, 3,408,194, German Patent Application (OLS) 2,057,941, 2,213,461, 2,219,917, 2,261,361, 2,263,875, etc.

Suitable magenta couplers which can be used include mainly 5-pyrazolone compounds. In addition, indazolone compounds and cyanoacetyl compounds can also be used. Examples of suitable magenta couplers are described in e.g., U.S. Pat. Nos. 2,439,098, 2,600,788, 3,062,653, 3,558,319, British Pat. No. 956,261, U.S. Pat. Nos. 3,582,322, 3,615,506, 3,519,429, 3,311,476, 3,419,391, 3,935,015, German Patent Application (OLS) 2,424,467, German Pat. No. 1,810,464, Japanese Patent Publication 2,016/69, German Patent Application (OLS) 2,418,959, Japanese Patent Application (OPI) 42,726/77, U.S. Pat. No. 2,983,608, German Patent Application (OLS) 2,532,225, 2,536,191, Japanese Patent Application (OPI) 16,924/76, etc.

Phenol or naphthol derivatives are predominantly used as cyan couplers. Suitable examples of cyan couplers are described in, e.g., U.S. Pat. Nos. 2,369,929, 2,474,293, 2,698,794, 2,895,826, 3,311,476, 3,458,315, 3,560,212, 3,582,322, 3,591,383, 3,386,301, 2,434,272, 2,706,684, 3,034,892, 3,583,971, German Patent Application (OLS) 2,163,811, Japanese Patent Publication 28,836/70, Japanese Patent Application (OPI) 122,335/74, etc.

In addition, couplers capable of releasing a development inhibitor upon color reaction (so-called DIR couplers) or compounds capable of releasing a development inhibiting compound may also be employed. Examples of these couplers are described in, e.g., U.S. Pat. Nos. 3,148,062, 3,227,554, 3,253,924, 3,617,291, 3,622,328, 3,705,201, British Pat. No. 1,201,110, U.S. Pat. Nos. 3,297,445, 3,379,529, 3,639,417, etc.

Colored couplers can also be used in the present invention, and examples are illustrated in U.S. Pat. Nos. 2,434,272, 3,476,564, 3,476,560, Japanese Patent Publication 1175/78, U.S. Pat. Nos. 3,034,892, 3,386,301, 2,434,272, 3,148,062, 3,227,554, 3,701,783, 3,617,291, etc.

The color image stabilizer of the general formula (I) used in the present invention is suitably employed in an amount of about 0.5 to about 200% by weight, preferably 2 to 150% by weight, based on the weight of the couplers, although the amount thereof will vary some depending upon the type of coupler employed. The color image stabilizer of the formula (I) used in the present invention is preferably employed in an amount of about 2 to 150% by weight, based on the weight of the magenta couplers or cyan couplers. A classic magenta coupler is a 5-pyrazolone type magenta coupler such as 3-anilino-5-pyrazolone and 3-(2-chloroanilino)-5-pyrazolone and, 3-(2-chloroanilino)-5-pyrazolone is preferred. A classic cyan coupler is a phenol type cyan coupler and a 2-acylaminophenol type cyan coupler is preferred. Particularly preferred effects are obtained when the color image stabilizer of the formula (I) is employed together with a magenta coupler rather than a cyan coupler.

If the compound of the formula (I) is employed in an amount less than the above-described range, extremely poor effects in preventing fading or discoloration of color images and discoloration of background are achieved and thus it is practically unsuitable. On the other hand, if the compound of the formula (I) is used in an amount larger than the above-described range, it can inhibit the progress of development and cause a reduction in color density.

In practicing the present invention, known antifading agents can be used together with the compound of the formula (I), and the color image stabilizer of the present invention of the formula (I) can be used individually or as combinations of two or more. Anti-fading agents which can be used include hydroxychroman compounds, alkyl nuclear-substituted hydroquinone compounds, alkoxyphenol compounds, bisphenol compounds, alkoxychroman compounds and alkyl nuclear-substituted 1,4-dialkoxybenzene compounds. Specific anti-fading agents include, for example, the hydroquinone derivatives described in U.S. Pat. Nos. 2,360,290, 2,418,613, 2,675,314, 2,701,197, 2,704,713, 2,728,659, 2,732,300, 2,735,765, 2,710,801, 2,816,028, British Pat. No. 1,363,921, etc., the gallic acid derivatives described in U.S. Pat. Nos. 3,457,079, 3,069,262, Japanese Patent Publication 13,496/68, etc., the p-alkoxyphenols described in U.S. Pat. Nos. 2,735,765, 3,698,909, Japanese Patent Publication 20,977/74, etc., the p-hydroxyphenol derivatives described in U.S. Pat. Nos. 3,432,300, 3,573,050, 3,574,627, 3,764,337, etc., the bisphenol type anti-fading agents described in Japanese Patent Application (OPI) 35,633/77, 72,225/77, the alkoxychroman type anti-fading agents described in Japanese Patent Application (OPI) 17,729/78, and the alkyl nuclear-substituted 1,4-dialkoxybenzene type anti-fading agents described in Japanese Patent Application (OPI) 17,729/78. Particularly preferred know anti-fading agents which can be used together with the color image stabilizer of the formula (I) are hydroxychroman, alkyl nuclear-substituted hydroquinone, bisphenol compounds and alkyl nuclear-substituted 1,4-dialkoxybenzene compounds.

To incorporate the compound of the present invention (color image stabilizer) into a photographic layer of a color light-sensitive material, it is possible, for example, to dissolve the compound in a low boiling organic solvent such as ethyl acetate, ethanol, etc., and directly add the solution thereof to a silver halide emulsion or to a coupler dispersion mixture without emulsification. However, it is desirable to dissolve the compound of the present invention (color image stabilizer) in a high boiling solvent such as dibutyl phthalate, tricresyl phosphate, etc., together with a coupler and, if desired, in the presence of a low boiling auxiliary solvent and add such to a silver halide emulsion as an emulsion dispersion of the color image stabilizer alone or together with a coupler dispersed as oil droplets in a water-soluble protective colloid such as gelatin.

Illustrative photographic layers to which the compound of the present invention (color image stabilizer) can be added include coupler-containing silver halide light-sensitive emulsion layers (e.g., a red-sensitive silver halide emulsion layer, a green-sensitive silver halide emulsion layer, a blue-sensitive silver halide emulsion layer) and light-insensitive photographic auxiliary layers (e.g., a protective layer, a filter layer, an interlayer, a subbing layer, etc.), in the color photographic light-sensitive material. More preferably, the compound of the present invention is added to a green-sensitive silver halide emulsion layer, a red-sensitive silver halide emulsion layer, a protective layer or an interlayer which is present above a green-sensitive layer in conventional constructions. In particular, it is preferred for the color image stabilizer of the present invention be present in a magenta coupler-containing photographic layer. That is, the compound is particularly effective for preventing fading or discoloration of magenta images.

The compound of the present invention can also be incorporated in a mordanted layer (image receiving layer) of diffusion transfer color photographic light-sensitive materials in an amount of about 0.1 to 2 moles based on total dye amount transferred to the mordanted layer.

Typical examples of high boiling organic solvents which can be used for dispersing the color image stabilizer of the present invention alone or in combination with a coupler include butyl phthalate, dinonyl phthalate, butyl benzoate, diethylhexyl sebacate, butyl stearate, dinonyl maleate, tributyl citrate, tricresyl phosphate, dioctyl butyl phosphate, trihexyl phosphate, trioctadecyl phosphate, etc. as described in U.S. Pat. No. 3,676,137, diethyl succinate, dioctyl adipate, 3-ethylbiphenyl, liquid dye stabilizers described, as improved photographic dye image stabilizers, in *Product Licensing Index,* Vol. 83, pp. 26–29 (March, 1971).

Examples of low boiling organic solvents which can be used as auxiliary solvents together with a high boiling organic solvent include ethyl acetate, butyl acetate, ethyl propionate, ethyl formate, butyl formate, nitroethane, carbon tetrachloride, chloroform, hexane, cyclohexane, ethylene glycol, acetone, ethanol, dimethylformamide, dioxane, etc. In addition, it is also possible to use benzene, toluene, xylene, etc., with these solvents.

Surface active agents can also be used in dispersing a solution of the color image stabilizer alone or in combination with a coupler in an aqueous protective colloid solution, and illustrative examples thereof include saponin, sodium alkylsulfosuccinates, sodium alkylbenzenesulfonates, etc., and examples of the hydrophilic protective colloid which can be used are gelatin, casein, carboxymethyl cellulose, polyvinyl alcohol, polyvinyl pyrrolidone, styrene-maleic anhydride copolymers, condensates of styrene-maleic anhydride copolymers and polyvinyl alcohol, polyacrylic acid salts, ethyl cellulose, etc. However, the present invention is not limited only to these examples.

Suitable supports which can be used in the present invention include those which are commonly used for photographic light-sensitive materials such as a cellulose nitrate film, a cellulose acetate film, a cellulose acetate butyrate film, a cellulose acetate propionate film, a polystyrene film, a polyethylene terephthalate film, a polycarbonate film, a laminate of these films, a thin glass plate, paper, and the like. Papers coated or laminated with baryta or an α-olefin polymer, in particular, a polymer of an α-olefin having 2 to 10 carbon atoms such as polyethylene, polypropylene, an ethylene-butene copolymer, etc., synthetic resin films whose surface has been roughened to improve intimately the adhesive property with other polymers as described in Japanese Patent Publication 19,068/72 also provide good results.

Suitable supports include transparent or opaque supports which are selected depending upon the end-use of the light-sensitive materials. Also, transparent supports colored with a dye or pigment can be used as well.

Suitable opaque supports include intrinsically opaque supports like paper and, in addition, that prepared by adding dyes or pigments like titanium oxide to a transparent film, a synthetic resin film which has been surface-treated according to the method described in Japanese Patent Publication 19,068/72, papers or synthetic resin films to which carbon black, a dye or the like has been added to render them completely light-intercepting, and the like. A subbing layer is usually provided on the support. The surface of the support may be subjected to a preliminary processing such as a corona discharge, an irradiation with ultraviolet light, a flame treatment, etc.

In practicing the present invention, it is natually additionally effective and advantageous to prevent fading or discoloration by light to provide an ultraviolet light-absorbing layer on the upper surface of a photographic light-sensitive image-forming layer upon coating on a support.

The color processing agents such as color developing agents, bleaching agents, fixing agents, etc. used in the present invention are not limited and any conventional agent may be used. In particular, the present invention can advantageously be employed in silver-saving type color light-sensitive materials described in U.S. Pat. No. 3,902,905, etc. Also, the present invention is not limited by the kind of intensifying agents used for color intensifying processing as described in German Patent Application (OLS) 181,390, Japanese Patent Application (OPI) 9,728/73, Japanese Patent Publication 14,625/77, etc.

The present invention is applicable to ordinary color light-sensitive materials, in particular, color light-sensitive materials for color prints. Further, it is applicable to the color photographic system described in U.S. Pat. Nos. 3,227,550, 3,227,551, 3,227,552, U.S. Provisional Patent Publication No. U.S.B. 351,673, etc., in particular, to the color diffusion transfer photographic system.

Color photographic development processing is necessary after exposure in order to obtain dye images using the color photographic light-sensitive material of the present invention. Color photographic development processing fundamentally involves a color developing step, a bleaching step, and a fixing step. In some cases, two of these steps are conducted in one processing. In addition, a combination of color development, first fixing and bleach-fixing is also possible. The development processing step is combined with, if necessary, a prehardening bath, a neutralizing bath, a first development (black-and-white development), an image-stabilizing bath, a washing or the like. A suitable processing temperature is in many cases about 18° C. or above. Particularly, the processing temperature can be about 20° C. to 60° C., and more recently about 30° C. to about 60° C.

A suitable color developer solution which can be used is an alkaline aqueous solution having a pH of about 8 or higher, preferably 9 to 12, containing a color developing agent. Preferred and typical examples of the above-described color developing agent are 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 4-amino-3-methyl-N-ethyl-N-β-methanesulfoamidoethylaniline, 4-amino-N,N-dimethylaniline, 4-amino-3-methoxy-N,N-diethylaniline, 4-amino-3-methyl-N-ethyl-N-β-methoxyethylaniline, 4-amino-3-methoxy-N-ethyl-N-β-methoxyethylaniline, 4-amino-3-β-methanesulfoamidoethyl-N,N-diethylaniline, and the salts thereof (e.g., sulfates, hydrochlorides, sulfites, p-toluenesulfonates, etc.). Other examples are described in U.S. Pat. Nos. 2,193,015, 2,592,364, Japanese Patent Application (OPI) 64,933/73, L. F. A. Mason, *Photographic Processing Chemistry,* pp. 226–229, Focal Press, London (1966), etc.

The color developer solution can further contain pH buffers such as alkali metal sulfited, carbonates, borates or phosphates, development inhibitors or anti-fogging agents such as bromides, iodides or organic anti-fogging agents.

Specific examples of the anti-fogging agents includes potassium bromide, potassium iodide, nitrobenzimidazoles described in U.S. Pat. Nos. 2,496,940 and 2,656,271, mercaptobenzimidazole, 5-methylbenzotriazole, 1-phenyl-5-mercaptotetrazole, compounds described in U.S. Pat. Nos. 3,113,864, 3,342,596, 3,295,976, 3,615,522, 3,597,199, etc., thiosulfonyl compounds described in British Pat. No. 972,211, phenazine-N-oxides as described in Japanese Patent Publication 41,675/71, anti-fogging agents described in *Kagaku Shashin Binran,* Vol. II, pp. 29–47, and the like.

In addition, the color developer solution may contain, if desired, a water softener, a preservative such as hydroxylamine, an organic solvent such as benzyl alcohol, diethylene glycol, etc., a development accelerator such as polyethylene glycol, a quaternary ammonium salt, an amine, etc., a dye-forming coupler, a competitive coupler, a fogging agent such as sodium borohydride, an auxiliary developing agent such as 1-phenyl-3-pyrazolidone, a viscosity-imparting agent, and the like.

The color light-sensitive material of the present invention can be subjected to ordinary color development processing or to the following color intensifying development processing: for example, a processing using peroxides described in U.S. Pat. Nos. 3,674,490, 3,761,265, German Patent Application (OLS) 2,056,360, Japanese Patent Application (OPI) 6,338/72, 10,538/72, 13,335/77, 13,334/77 and 13,336/77, etc.; a processing using cobalt complex salts described in German Patent Application (OLS) 2,266,770, Japanese Patent Applications (OPI) 9,728/73, 9,729,73, 6,026/76, 94,822/76, 133,023/76, 7,728/77, 11,034/77, etc.; and a processing using chlorous acid described in Japanese Patent Publication 14,625/77, Japanese Patent Application (OPI) 99,022/76 and 103,430/76, etc.

After color development processing, the photographic emulsion layer is usually subjected to bleaching. Bleaching may be conducted either simultaneously with fixing or independnetly thereof. Suitable bleaching agents which can be used include compounds of multivalent metals such as iron (III), cobalt (III), chromium (VI), copper (II), etc., peracids, quinones, nitroso compounds, etc. For example, ferricyanides, dichromates, organic complex salts of iron (III) or cobalt (III), complex salts of aminopolycarboxylic acids (e.g., ethylenediaminetetraacetic acid, nitrilotriacetic acid, 1,3-diamino-2-propanoltetraacetic acid, etc.) or of organic acids (e.g., citric acid, tartaric acid, malic acid, etc.); persulfates, permanganates; nitrosophenol, etc., can be used. Of these, potassium ferricyanide, iron (III) sodium ethylenediaminetetraacetate and iron (III) ammonium ethylenediaminetetraacetate are particularly useful. Ethylenediaminetetraacetic acid-iron (III) complex salt is effective in a belaching solution and in a monobath bleach-fixing solution.

Various additives including bleaching-accelerators described in U.S. Pat. Nos. 3,042,520, 3,241,966, Japanese Patent Publications 8,506/70, 8,836/70, etc., can be added to the bleaching solution or bleach-fixing solution.

The present invention is illustrated in greater detail by reference to the following examples which, however, are not to be construed as limiting the present invention in any way. Unless otherwise indicated all parts and percentages are by weight.

EXAMPLE 1

10 g of 1-(2,4,6-trichlorophenyl)-3-(2-chloro-5-tetradecanamido)anilino-5-pyrazolone (as a magenta coupler) was dissolved in 10 ml of tricresyl phosphate and 20 ml of ethyl acetate, and the resulting solution was dispersed in 80 g of a 10% gelatin aqueous solution containing 5 ml of a 1% aqueous solution of sodium dodecylbenzenesulfonate. Then, this dispersion was mixed with 145 g of a green-sensitive silver chlorobromide emulsion (Bromide: 50 mol%) (containing 7 g of silver) and it was coated on a paper support both sides of which were laminated with polyethylene in an amount of 200 mg/m$^2$ in terms of the coupler, then dried. On this layer a gelatin protective layer was coated (gelatin 1 g/m$^2$) to prepare Sample A.

In the same manner as Sample A, a sample in which 2.9 g of Compound (10) according to the present invention was added when the magenta coupler was dissolved in tricresyl phosphate and ethyl acetate (Sample B), and samples in which the comparative compounds shown in Table 1 below were added in the place of Compound (10), respectively.

TABLE 1

| Sample | Color Image Stabilizer | Amount Added/ 10 g Coupler | |
|---|---|---|---|
| A | None | — | Control |
| B | Compound (10) | 2.9 g | Invention |
| C | 2,5-Di-tert-octyl-hydroquinone | 2.9 g | Comparison |
| D | α-Tocopherol | 2.9 g | Comparison |

TABLE 1-continued

| Sample | Color Image Stabilizer | Amount Added/ 10 g Coupler | |
|---|---|---|---|
| E | 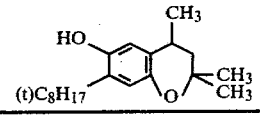 | 2.9 g | Comparison |

After exposing these samples for 1 second to light of 1,000 lux using a sensitometer, they were processed in the following manner.

| Processing Step | Temperature (°C.) | Time |
|---|---|---|
| Color Development | 33 | 3 min 30 sec |
| Bleach-Fixing | 33 | 1 min 30 sec |
| Washing | 30 | 3 min |
| Drying | | |

| Color Developer Solution | |
|---|---|
| Benzyl Alcohol | 15 ml |
| Sodium Sulfite | 5 g |
| Potassium Bromide | 0.5 g |
| Hydroxylamine Sulfate | 3 g |
| 4-(N-ethyl-N-β-methanesulfonamidoethylamino)-2-methylaniline Sesquisulfate | 6 g |
| Sodium Carbonate (monohydrate) | 28 g |
| Water to make | 1,000 ml (pH 10.0) |
| **Bleach-Fixing Solution** | |
| Ferric Ethylenediaminetetraacetate | 45 g |
| Sodium Sulfite | 10 g |
| Ammonium Thiosulfate (70% aqueous solution) | 160 ml |
| Tetrasodium Ethylenediaminetetraacetate | 5 g |
| Water to make | 1,000 ml (pH 6.8) |

Each of the thus obtained samples A to E was subjected to a fading test for 2 weeks using a fluorescent lamp fading tester (20,000 lux) equipped with an ultraviolet light-absorbing filter, C-40, absorbing light of a wa velength of 400 nm or shorter (made by Fuji Photo Film Co., Ltd.). The results obtained are shown in Table 2 below.

TABLE 2

| Sample | Magenta Density after Fading Test (Initial Density of 2.0) |
|---|---|
| A | 0.35 |
| B | 1.85 |
| C | 1.01 |
| D | 1.48 |
| E | 1.60 |

It is apparent from the results shown in Table 2 above that the compound according to the present invention remarkably improves the stability of color images and has large stabilization effects in comparison with known color image stabilizers.

EXAMPLE 2

In the same manner as Samples A to E described in Example 1 using 1-(2,4,6-trichlorophenyl)-3-(2-chloro-5-tetradecanamido)anilino-5-pyrazolone, a coating composition for a green-sensitive layer having the composition shown in Table 5 below and containing the color image stabilizer shown in Table 3 below was prepared and a multilayer sample having the layer structure shown in Table 5 was prepared.

TABLE 3

| Sample | Color Image Stabilizer | Amount Added/ 10 g Coupler | |
|---|---|---|---|
| F | None | | Comparison |
| G | Compound (11) | 3.0 g | Invention |
| H | Compound (11) + 2,5-Di-tert-octylhydroquinone | 1.0 g | Invention |
| I | α-Tocopherol | 3.0 g | Comparison |

These samples were exposed through a light wedge for 1 second to light of 1,000 lux equipped with a green filter, SP-2(made by Fuji Photo Film Co., Ltd.). Then, these samples were subjected to the same processing as described in Example 1 and to fading testing for 3 weeks using a fluorescent lamp fading tester (20,000 lux). The measurement of optical density was carried out using a Macbeth densitometer. The results obtained are shown in Table 4 below.

TABLE 4

| Sample | Change of Yellow Density in White Background (Initial Density of 0.10) | Change of Magenta Density (Initial Density of 2.0) |
|---|---|---|
| F | + 0.30 | − 0.80 |
| G | + 0.20 | − 0.40 |
| H | + 0.14 | − 0.25 |
| I | + 0.28 | − 0.65 |

TABLE 5

| | |
|---|---|
| Sixth Layer: (Protective layer) | Gelatin (1,000 mg/m$^2$) |
| Fifth Layer: (Red-sensitive layer) | Silver Chlorobromide emulsion (Br: 50 mol%), Silver (300 mg/m$^2$), Gelatin (1,000 mg/m$^2$), Cyan coupler*1 (400 mg/m$^2$), Coupler solvent*2 (200 mg/m$^2$) |
| Fourth Layer: (Inter layer) | Gelatin (1,200 mg/m$^2$), Ultraviolet light-absorbing agent*3 (1,000 mg/m$^2$), Ultraviolet light-absorbing agent solvent*2 (250 mg/m$^2$) |
| Third Layer: (Green-sensitive layer) | Silver Chlorobromide emulsion (Br: 50 mol %), Silver (290 mg/m$^2$), Gelatin (1,000 mg/m$^2$), Magenta Coupler*4 (200 mg/m$^2$), Coupler Solvent*5 (200 mg/m$^2$) |
| Second Layer: (Inter layer) | Gelatin (1,000 mg/m$^2$) |
| First Layer: (Blue-sensitive layer) | Silver Chlorobromide emulsion (Br: 80 mol %), Silver (400 mg/m$^2$), Gelatin (1,200 mg/m$^2$), Yellow coupler*6 (300 mg/m$^2$), Coupler solvent*7 (150 mg/m$^2$) |
| Support: | Paper support both surfaces of which were laminated with polyethylene |

*1Coupler: 2-[α-(2,4-Di-tert-pentylphenoxy)-butanamido]-4,6-dichloro-5-methylphenol
*2Solvent: Dibutyl phthalate
*3Ultraviolet light-absorbing agent: 2-(2-Hydroxy-3-sec-butyl-5-tert-butylphenyl)-benzotriazole
*4Coupler: 1-(2,4,6-Trichlorophenyl)-3-[2-chloro-5-tetradecanamido]anilino-2-pyrazolin-5-one
*5Solvent: Tricresyl phosphate
*6Coupler: α-Pivaloyl-α-[2,4-dioxo-5,5'-dimethyloxazolidin-3-yl]-2-chloro-5-[α-(2,4-di-tert-pentylphenoxy)-butanamido]acetanilide
*7Solvent: Dioctyl Butyl Phosphate The samples of the present invention were greatly improved in the stability of color images, and the combined use with a known color image stabilizer (2,5-di-tert-octylhydroquinone) further improved the change in the yellow density of the white background and improved the color image stability. These show the excellent effects according to the present invention.

While the invention has been described in detail and with reference to specific embodiments thereof, it will be apparent to one skilled in the art that various changes and modifications can be made therein without departing from the spirit and scope thereof.

What is claimed is:

1. A color photographic color coupler-containing silver halide light-sensitive material containing, in a photographic layer, at least one compound represented by the following general formula (I):

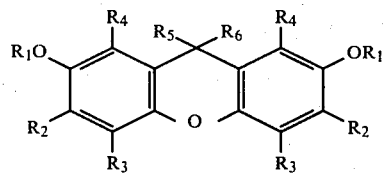

(I)

wherein $R_1$ represents a hydrogen atom, an alkyl group, a heterocyclic group, a dialkylsilyl group, a trialkylsilyl group, an alkanesulfonyl group, an arylsulfonyl group, an aralkanesulfonyl group or an -X-Y group in which X represents a carbonyl group, and Y represents an alkyl group, an aryl group, an aralkyl group, an alkoxy group, an aryloxy group, an aralkoxy group, an alkylamino group, a dialkylamino group, an arylamino or diarylamino group, an alkoxycarbonyl group, an aryloxycarbonyl group, an aralkoxycarbonyl group or an acyl group; $R_2$, $R_3$ and $R_4$, which may be the same or different, each represents a hydrogen atom, an alkyl group, an alkoxy group, an aryl group, an aryloxy group, an aralkyl group, an aralkoxy group, an alkenyl group, an alkenoxy group, an acylamino group, a halogen atom, an alkylthio group, an arylthio group, a diacylamino group, an acyl group, a sulfonamido group, an alkylamino group, an alkoxycarbonyl group or an acyloxy group; and $R_5$ and $R_6$, which may be the same or different, each represents a hydrogen atom, an alkyl group, an aryl group or an aralkyl group, or $R_5$ and $R_6$ are bonded each other to form a 5-membered, 6-membered or 7-membered ring.

2. The light-sensitive material of claim 1, wherein $R_1$ represents a hydrogen atom, an alkyl group or an acyl group, $R_2$, $R_3$ and $R_4$ each represents an alkyl group and $R_5$ and $R_6$ each represents a hydrogen atom or an alkyl group.

3. The light-sensitive material of claim 1, wherein said compound represented by the general formula (I) is present in an amount of about 0.5 to about 200% by weight based on the weight of the coupler.

4. The light-sensitive material of claim 1, wherein said compound represented by the formula (I) is present in an amount of 2 to 150% by weight based on the weight of the coupler.

5. The light-sensitive material of claim 1, wherein said photographic layer is a light-sensitive silver halide emulsion layer.

6. The light-sensitive material of claim 5, wherein said silver halide light-sensitive emulsion layer is a green-sensitive silver halide emulsion layer.

7. The light-sensitive material of claim 6, wherein said silver halide light-sensitve emulsion layer contains a coupler.

8. The light-sensitive material of claim 7, wherein said coupler is a magenta coupler.

9. The light-sensitive material of claim 8, wherein said magenta coupler is a 5-pyrazolone type magenta coupler.

10. The light-sensitive material of claim 1, wherein said photographic layer is a light-insensitive photographic auxiliary layer.

11. The light-sensitive material of claim 10, wherein said light-insensitive photographic auxiliary layer is an interlayer or a filter layer.

12. The light-sensitive material of claim 5, wherein said silver halide light-sensitive emulsion layer is a red-sensitive silver halide emulsion layer.

13. The light-sensitive material of claim 12, wherein said silver halide light-sensitive emulsion layer contains a coupler.

14. The light-sensitive material of claim 13, wherein said coupler is a cyan coupler.

15. The light-sensitive material of claim 14, wherein said cyan coupler is a phenol or naphthol derivative.

16. The light-sensitive material of claim 10, wherein said light-sensitive material is a diffusion transfer material and said photographic layer is an image receiving layer.

17. The light-sensitive material of claim 1, wherein said material is a color-negative film.

18. The light-sensitive material of claim 1, wherein said material is a color paper.

19. The light-sensitive material of claim 1, wherein said material is a diffusion transfer film unit.

20. The light-sensitive material of claim 1 wherein $R_1$ represents a hydrogen atom, a straight chain, branched chain or cyclic alkyl group having 1 to 20 carbon atoms, a heterocyclic group, a dialkylsilyl group, a trialkylsilyl group, a straight chain branched chain or cyclic alkanesulfonyl group having 1 to 20 carbon atoms, a substituted or unsubstituted arylsulfonyl group, an aralkanesulfonyl group or an —X—Y group in which X represents $>C=O$ (a carbonyl group), and Y represents a straight chain, branched chain or cyclic alkyl group having 1 to 20 carbon atoms, an aryl group which may be substituted, an aralkyl group, an alkoxy group containing a straight chain, branched chain or cyclic alkyl group having 1 to 20 carbon atoms, an aryloxy group which may be substituted, an aralkoxy group, an alkylamino group having 1 to 20 carbon atoms, a dialkylamino group, an arylamino group which may be substituted, a diarylamino group, an alkoxycarbonyl group containing a straight chain, branched chain or cyclic alkyl group having 1 to 20 carbon atoms, an aryloxycarbonyl group which may be substituted, an aralkoxycarbonyl group or an acyl group; $R_2$, $R_3$ and $R_4$, which may be the same or different, each represents a hydrogen atom, a straight chain, branched chain or cyclic alkyl group having 1 to 20 carbon atoms, a straight chain, branched chain or cyclic alkoxy group having 1 to 20 carbon atoms, a substituted or unsubstituted aryl group, a substituted or unsubstituted aryloxy group, an aralkyl group, an aralkoxy group, an alkenyl group, an alkenoxy group, an acylamino group, a halogen atom, an alkylthio group containing a straight chain, branched chain or cyclic alkyl group having 1 to 20 carbon atoms, a substituted or unsubstituted arylthio group, a diacylamino group, a substituted or unsubstituted acyl group having 1 to 20 carbon atoms, a sulfonamido group, an alkylamino group containing a straight chain or branched chain alkyl group having 1 to 20 carbon atoms, an alkoxycarbonyl group containing a straight chain or branched chain alkyl group having 1 to 20 carbon atoms or an acyloxy group having 1 to 20 carbon atoms; and $R_5$ and $R_6$, which may be the same or different, each represents a hydrogen atom, a straight chain, branched chain or cyclic alkyl group having 1 to 20 carbon atoms, a substituted or unsubstituted aryl group or an aralkyl group, or $R_5$ and $R_6$ are bonded each other to form a 5-membered, 6-membered or 7-membered ring.

* * * * *